US010050334B2

(12) United States Patent
Wang et al.

(10) Patent No.: US 10,050,334 B2
(45) Date of Patent: Aug. 14, 2018

(54) ANTENNA AND MOBILE TERMINAL INCLUDING THE SAME

(71) Applicant: Beijing Xiaomi Mobile Software Co., Ltd., Beijing (CN)

(72) Inventors: Linchuan Wang, Beijing (CN); Zonglin Xue, Beijing (CN); Xiaofeng Xiong, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 31 days.

(21) Appl. No.: 15/347,297

(22) Filed: Nov. 9, 2016

(65) Prior Publication Data

US 2017/0288297 A1 Oct. 5, 2017

(30) Foreign Application Priority Data

Mar. 29, 2016 (CN) ..... 2016 1 0188058

(51) Int. Cl.
*H01Q 1/24* (2006.01)
*H01Q 1/22* (2006.01)
(Continued)

(52) U.S. Cl.
CPC ..... *H01Q 1/243* (2013.01); *H01Q 1/2291* (2013.01); *H01Q 1/42* (2013.01); *H01Q 1/48* (2013.01);
(Continued)

(58) Field of Classification Search
CPC ..... H01Q 1/243; H01Q 1/42; H01Q 1/521; H01Q 1/48; H01Q 1/2291; H01Q 5/385; H01Q 7/00
See application file for complete search history.

(56) References Cited

U.S. PATENT DOCUMENTS 7,978,141 B2 7/2011 Chi et al.
2008/0316121 A1* 12/2008 Hobson ..... H01Q 1/243 343/702
(Continued)

FOREIGN PATENT DOCUMENTS

CN 103579762 A 2/2014
CN 104167605 A 11/2014
(Continued)

OTHER PUBLICATIONS

International Search Report and Written Opinion issued in corresponding International Application No. PCT/CN2016/100077, dated Jan. 3, 2017, 11 pages.
(Continued)

*Primary Examiner* — Dameon E Levi
*Assistant Examiner* — Ab Salam Alkassim, Jr.
(74) *Attorney, Agent, or Firm* — Arch & Lake LLP

(57) ABSTRACT

An antenna is provided to be applied in a mobile terminal having a metal body. The antenna includes: a feed point; a first ground point; and a metal dome connected with the feed point. A metal frame is extended from an upper side of the metal body. The metal frame is provided with a slit. The metal dome is fixedly connected with the metal frame at an end near the slit. The feed point is disposed on the metal body and under the metal dome. The first ground point is disposed on the metal body and connected with the metal frame.

18 Claims, 1 Drawing Sheet

(51) Int. Cl.

| | |
|---|---|
| ***H01Q 1/48*** | (2006.01) |
| ***H01Q 1/42*** | (2006.01) |
| ***H01Q 7/00*** | (2006.01) |
| *H01Q 1/52* | (2006.01) |
| *H01Q 5/385* | (2015.01) |

(52) U.S. Cl.
CPC ..... *H01Q 7/00* (2013.01); *H01Q 1/521* (2013.01); *H01Q 5/385* (2015.01)

(56) References Cited

U.S. PATENT DOCUMENTS

| | | | | |
|---|---|---|---|---|
| 2009/0067141 | A1* | 3/2009 | Dabov | H01Q 1/243 361/753 |
| 2009/0273530 | A1 | 11/2009 | Chi et al. | |
| 2011/0109516 | A1 | 5/2011 | Hobson et al. | |
| 2012/0218723 | A1* | 8/2012 | Kwak | H01Q 1/243 361/748 |
| 2012/0229347 | A1* | 9/2012 | Jin | H01Q 1/243 343/702 |
| 2012/0235866 | A1* | 9/2012 | Kim | H01Q 1/243 343/700 MS |
| 2012/0262345 | A1* | 10/2012 | Kim | H01Q 1/243 343/702 |
| 2013/0162485 | A1 | 6/2013 | Hobson et al. | |
| 2014/0028503 | A1 | 1/2014 | Chien et al. | |
| 2014/0078008 | A1* | 3/2014 | Kang | H01Q 5/35 343/702 |
| 2014/0225789 | A1* | 8/2014 | Katayama | H01Q 1/02 343/702 |
| 2015/0214602 | A1 | 7/2015 | Hobson et al. | |
| 2016/0064820 | A1* | 3/2016 | Kim | H01Q 1/243 343/767 |
| 2016/0233574 | A1* | 8/2016 | Xiong | H01Q 5/50 |
| 2017/0054200 | A1 | 2/2017 | Kang et al. | |
| 2017/0294709 | A1* | 10/2017 | Xue | H01Q 1/48 |

FOREIGN PATENT DOCUMENTS

| | | | | |
|---|---|---|---|---|
| CN | 104347927 | A | 2/2015 | |
| CN | 104577334 | A | 4/2015 | |
| CN | 204538197 | U | 8/2015 | |
| WO | WO 2015010639 | A1 * | 1/2015 | H01Q 1/243 |

OTHER PUBLICATIONS

Extended European Search Report issued in corresponding EP Application No. 16199867, dated Jun. 21, 2017, 8 pages.

* cited by examiner

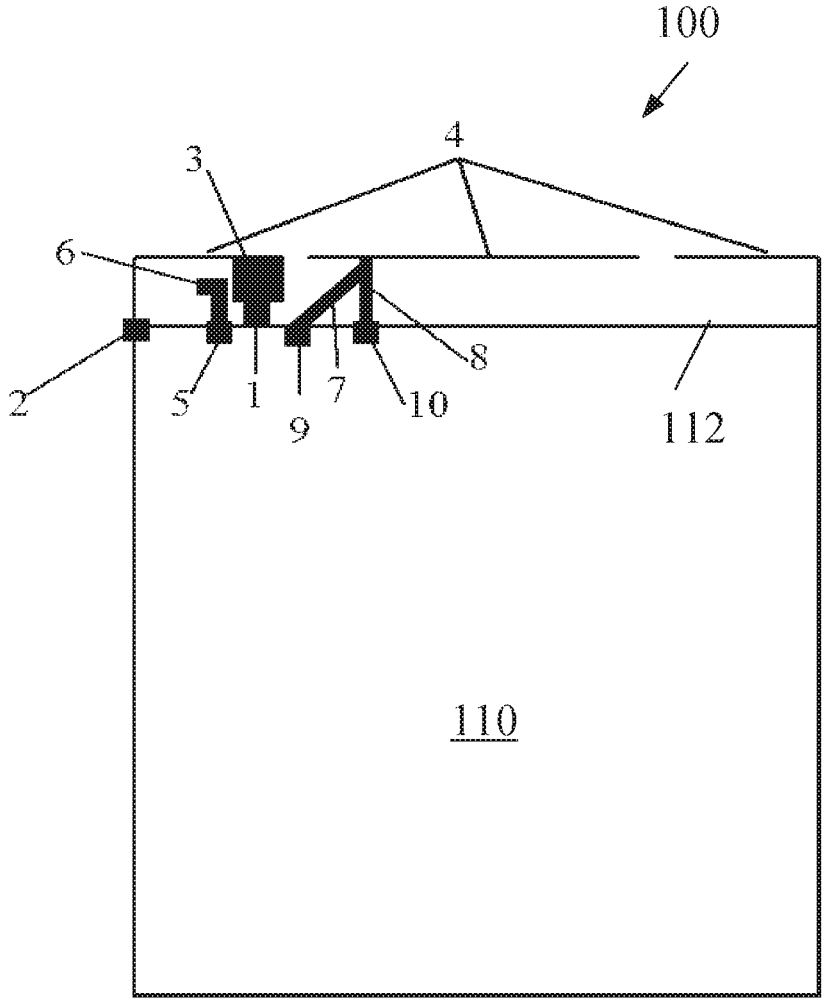
100
4
3
6
2
5
1
9
7
10
8
112
110

ANTENNA AND MOBILE TERMINAL INCLUDING THE SAME

CROSS-REFERENCE TO RELATED APPLICATION

This application is based on and claims priority to Chinese Patent Application No. 201610188058.2 filed on Mar. 29, 2016, which is incorporated herein by reference in its entirety.

FIELD

The present disclosure generally relates to a WIFI antenna, and more particularly to an antenna of an all-metal mobile phone.

BACKGROUND

With the increasing development of communication device technology, an electronic device may need to support a variety of networks such as Global System for Mobile Communications (GSM), 3rd-generation (3G), Long Term Evolution (LTE). Wireless Fidelity (WIFI), Global Positioning System (GPS) and the like, and thus the number of antennas of the electronic device is required to increase to a corresponding number. For example, a smart phone may be disposed with 4 to 6 or more antennas.

More and more electronic devices, such as a mobile phone, a tablet and the like, have a metal frame which is more and more popular because of its fashionable designs. The all-metal body is becoming a major appearance of the mobile phone. There are more and more metal elements in the mobile phone. The increase of metal elements, however, results in the decrease of antenna headroom, which may impact on signal radiation and reception of the antenna. This challenges design of the antenna.

The WIFI antenna structure provided by the present application is specially designed for a metal body. The WIFI antenna structure may not only improve the performance of the WIFI antenna, but also guarantee a good isolation with other antennas surrounded.

SUMMARY

In a first aspect, an antenna is provided that may be applied in a mobile terminal having a metal body. The antenna includes: a feed point; a first ground point; and a metal dome connected with the feed point. A metal frame is extended from an upper side of the metal body, and the metal frame includes a slit. The metal dome is fixedly connected with the metal frame at an end near the slit. The feed point is disposed on the metal body and under the metal dome. The first ground point is disposed on the metal body and connected with the metal frame.

In a second aspect, a mobile terminal including a metal body and the above antenna are provided. The metal body includes a metal frame. The antenna includes: a feed point; a first ground point; and a metal dome connected with the feed point. The metal frame is extended from an upper side of the metal body, and the metal frame includes a slit. The metal dome is fixedly connected with the metal frame at an end near the slit. The feed point is disposed on the metal body and under the metal dome. The first ground point is disposed on the metal body and connected with the metal frame.

It is to be understood that both the foregoing general description and the following detailed description are exemplary and explanatory only and are not restrictive of the disclosure.

BRIEF DESCRIPTION OF THE DRAWINGS

FIG. 1 is a schematic diagram illustrating an antenna according to an exemplary embodiment of the present application.

DETAILED DESCRIPTION

Reference will now be made in detail to example embodiments, examples of which are illustrated in the accompanying drawings. The following description refers to the accompanying drawings in which same numbers in different drawings represent same or similar elements unless otherwise described. The implementations set forth in the following description of example embodiments do not represent all implementations consistent with the present disclosure. Instead, they are merely examples of devices and methods consistent with aspects related to the present disclosure as recited in the appended claims.

The terms used in the present application are merely for the purpose to describe a specific example, rather than to limit the present application. The singular form "a", "an", and "the" used in the present application and the appended claims is intended to include plural form unless the context clearly indicates other meanings. It should be understand that the term "and/or" used herein is referred to include any or all possible combinations of one or more associated items listed.

It should be understand that although the present application may use terms first, second, and third to describe various information, the information are not limited to these terms. These terms are merely used to distinguish the same type of information from each other. For example, without departing from the scope of the present application, the first information may be referred to as the second information. Similarly, the second information may be referred to as the first information.

Reference throughout this specification to "one embodiment," "an embodiment," "exemplary embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

Referring to FIG. 1, a WIFI antenna applied in a mobile terminal 100 having a metal body 110 is provided. The WIFI antenna may include: a feed point 1; a first ground point 2; and a metal dome 3 connected with the feed point. A metal frame 4 may be extended from an upper side 112 of the metal body 110. The metal frame 4 may be provided with a slit. The metal dome 3 may be fixedly connected with the metal frame 4 at an end near the slit. The feed point 1 may be disposed on the metal body 110 and under the metal dome 3. For example, the feed point 1 may be disposed directly under the metal dome 3. The first ground point may be disposed on the metal body 110 and connected with the metal frame. The feed point, the metal dome, the metal frame, and the first ground point may together form a loop antenna which may serve as a WIFI 2.4G antenna.

A second around point 5 may be disposed between the feed point and the first ground point on the metal body 110. A ground metal strip 6 may be disposed on the second ground point. The second ground point 5 and the metal strip 6 may form a WIFI 5G antenna. Disposing the WIFI 5G antenna in an area surrounded by the WIFI 2.4G antenna may effectively decrease the space and area occupied by the WIFI antenna, and may avoid other metal elements (in the middle part) of the mobile phone to influence the usage environment of the WIFI antenna. The distance between the second ground point 5 and the feed point 1 may be larger than 0.5 mm and less than half of the distance between the first ground point 2 and the feed point 1. Namely, the second ground point is disposed at a position between the first ground point and the feed point and closer to the feed point. The second ground point 5 is closer to the feed point such that the energy may be coupled. If the second ground point 5 is far away from the feed point, the 5G antenna may not couple the energy of the 2.4G antenna and the performance of the 5G antenna may not be guaranteed.

A herringbone ground antenna may be disposed at another end near the slit. The herringbone ground antenna includes metal sheets 7 and 8 connected with the metal frame, and a third ground point 9 and a fourth ground point 10 both of which may be disposed on the metal body and connected with the metal sheets 7 and 8 respectively. The herringbone antenna may be used to guarantee the isolation between the WIFI 2.4G antenna, the WIFI 5G antenna, and other small antennas disposed in the mobile phone. The metal dome in the present application may be disposed as follows: the first way is to dispose the metal dome on a plastic antenna stand and directly abutted against the metal frame; the second way is to integrally form the metal dome on the metal frame; and the third way is to use a folded metal line, which is fixedly assembled on the metal frame via a screw and a nut, as the metal dome. The antenna dome may be connected with a WIFI chip via a radio-frequency transmission link. In the present application, the plastic antenna stand may be a general antenna stand structure, working principle and structure of which would not be described herein.

The third ground point 9 may be disposed directly under the slit. The metal sheet on the fourth ground point 10 may be disposed vertically and angled with the metal sheet on the third ground point. The metal sheet 7 on the third ground point 9 may be mainly used to finely adjust the frequency of WIFI low frequency resonance, and different angles of the metal sheet 7 may shift the WIFI low frequency resonance to lower frequency or higher frequency. Oblique disposition may decrease the path of the WIFI 2.4G antenna so as to integrally decrease the space occupied by the antenna. The metal sheet on the fourth ground point 10 may improve the isolation between the WIFI antenna and right hand LTE diversity antenna. There is no request for the angle so that the metal sheet on the fourth ground point may generally be disposed vertically.

The width of the slit may be 0.5 mm~2 mm. When the width of the slit is less than 0.5 mm, the radiation effect of the WIFI signal may be not good. If the width of the slit is larger than 2 mm, the appearance of the mobile phone may be influenced.

The metal frame may be provided with a second slit away from the slit as needed. The second slit may be provided far away from the slit to guarantee that other antennas in the mobile phone may use the metal body as a radiator. Thus, the performance of the antennas may be improved.

The above mentioned are preferable embodiments of the present application, and it is not intended to limit the present application. Various modifications and changes which are made without departing from the spirit and principle of the present application should be included in the scope of the present application.

What is claimed is:

1. A Wireless Fidelity (WIFI) antenna on a mobile terminal, comprising:

a feed point;

a first ground point; and a metal dome connected with the feed point;

wherein a metal frame is extended from an upper side of a metal body of the mobile terminal, and the metal frame is provided with a slit; the metal dome is fixedly connected with the metal frame at an end near the slit; the feed point is disposed on the metal body and under the metal dome; and the first ground point is disposed on the metal body and connected with the metal frame, wherein a second ground point is disposed between the feed point and the first ground point on the metal body, and a ground metal strip is disposed on the second ground point; and wherein a herringbone ground antenna is disposed at another end near the slit, and the herringbone ground antenna comprises metal sheets connected with the metal frame at the same location, and a third ground point and a fourth ground point both of which are disposed on the metal body and connected with the metal sheets.

2. The WIFI antenna of claim 1, wherein the metal dome is disposed on a plastic antenna stand and directly abutted against the metal frame.

3. The WIFI antenna of claim 1, wherein the metal dome is integrally formed on the metal frame.

4. The WIFI antenna of claim 1, wherein the metal dome is a folded metal line fixedly assembled on the metal frame via a screw and a nut.

5. The WIFI antenna of claim 1, wherein the second ground point is disposed at a position between the first ground point and the feed point and closer to the feed point.

6. The WIFI antenna of claim 1, wherein the third ground point is disposed directly under the slit; and the metal sheet on the fourth ground point is disposed vertically and angled with the metal sheet on the third ground point.

7. The WIFI antenna of claim 1, wherein width of the slit is 0.5 mm-2 mm.

8. The WIFI antenna of claim 1, wherein the metal frame is provided with a second slit away from the slit.

9. A mobile terminal, comprising:

a metal body comprising a metal frame; and an antenna comprising: a feed point, a first ground point, and a metal dome connected with the feed point, wherein the metal frame is extended from an upper side of the metal body, and the metal frame is provided with a slit; the metal dome is fixedly connected with the metal frame at an end near the slit; the feed point is disposed on the metal body and under the metal dome; and the first ground point is disposed on the metal body and connected with the metal frame;

wherein a second ground point is disposed between the feed point and the first ground point on the metal body, and a ground metal strip is disposed on the second ground point; and wherein a herringbone ground antenna is disposed at another end near the slit, and the herringbone ground antenna comprises metal sheets connected with the metal frame, and a third ground point and a fourth ground point both of which are disposed on the metal body and connected with the metal sheets.

10. The mobile terminal of claim 9, wherein the metal dome is disposed on a plastic antenna stand and directly abutted against the metal frame.

11. The mobile terminal of claim 9, wherein the metal dome is integrally formed on the metal frame.

12. The mobile terminal of claim 9, wherein the metal dome is a folded metal line fixedly assembled on the metal frame via a screw and a nut.

13. The mobile terminal of claim 9, wherein the second ground point is disposed at a position between the first ground point and the feed point and closer to the feed point.

14. The mobile terminal of claim 9, wherein the third ground point is disposed directly under the slit; and the metal sheet on the fourth ground point is disposed vertically and angled with the metal sheet on the third ground point.

15. The mobile terminal of any one of claim 9, wherein width of the slit is 0.5 mm-2 mm.

16. The mobile terminal of any one of claim 9, wherein the metal frame is provided with a second slit away from the slit.

17. The mobile terminal of claim 9, wherein the feed point, the metal dome, the metal frame, and the first ground point together form a loop antenna that serves as a WIFI 2.4G antenna; and wherein the second ground point and the metal strip serve as a WIFI 5G antenna.

18. The mobile terminal of claim 17, wherein the herringbone antenna is configured to guarantee isolation between the WIFI 2.4G antenna and the WIFI 5G antenna.

* * * * *